United States Patent [19]

Zybko et al.

[11] Patent Number: 4,680,209

[45] Date of Patent: Jul. 14, 1987

[54] SELF STICKING CARPET TILES

[75] Inventors: Walter C. Zybko; William Wald; Thomas V. McClure, all of Lexington, Va.

[73] Assignee: Burlington Industries, Inc., Greensboro, Md.

[21] Appl. No.: 884,929

[22] Filed: Jul. 14, 1986

Related U.S. Application Data

[63] Continuation-in-part of Ser. No. 837,352, Mar. 7, 1986, which is a continuation-in-part of Ser. No. 712,035, Mar. 15, 1985, Pat. No. 4,617,210.

[51] Int. Cl.[4] ..... B32B 7/14; D04H 1/08

[52] U.S. Cl. ..... 428/35; 156/291; 428/40; 428/95; 428/196; 428/198

[58] Field of Search ..... 156/291; 428/35, 40, 428/95, 196, 198

[56] References Cited

U.S. PATENT DOCUMENTS

| | | | |
|---|---|---|---|
| 3,847,647 | 11/1974 | Bahlo | 428/40 |
| 4,242,389 | 12/1980 | Howell | 428/95 |
| 4,380,563 | 4/1983 | Ayotte | 428/40 |

*Primary Examiner*—Marion C. McCamish

*Attorney, Agent, or Firm*—Cushman, Darby & Cushman

[57] ABSTRACT

A packaging system and method for self stick carpet tiles includes a first group of tiles with adhesive and non-stick material arranged on the bottom surfaces according to a first pattern and a second group of carpet tiles with adhesive and non-stick material arranged on the bottom surfaces according to a second pattern. The first and second group tiles are paired off with their bottom surfaces facing each other. The first and second patterns of adhesive and non-stick material are chosen so that adhesive on the tiles does not contact each other when the carpet tile pairs are formed.

The invention includes an apparatus for applying an adhesive or non-stick material to the backs of the carpet tiles, including a plurality of adhesive guns, a means for supplying adhesives to the plurality of adhesive guns, and a control means connected to the supplying means and to the plurality of adhesive guns for applying adhesive to the backs of carpet tiles and any one of a plurality of predetermined patterns.

42 Claims, 17 Drawing Figures

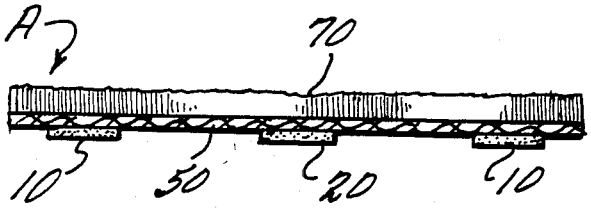
FIG. 4
FIG. 5
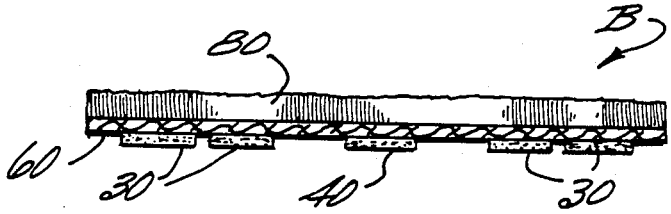
FIG. 6
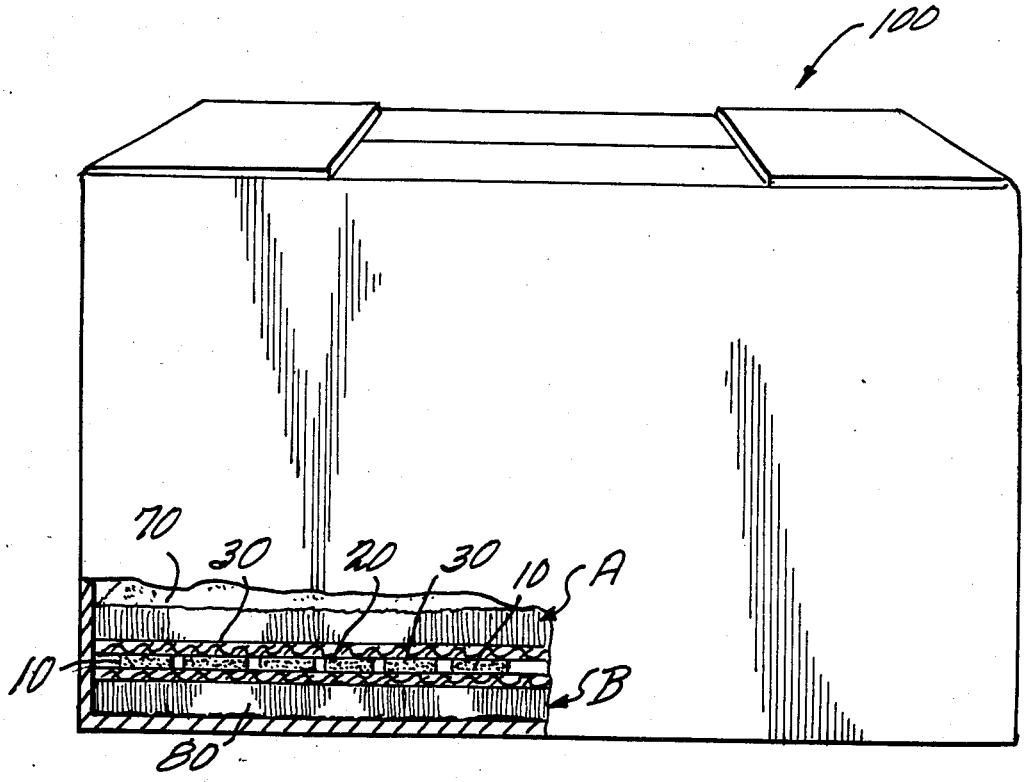

SELF STICKING CARPET TILES

The present application is a continuation in-part (CIP) of application Ser. No. 837,352 filed on Mar. 7, 1986 which was a continuation in-part (CIP) of application Ser. No. 712,035, filed Mar. 15, 1985, now U.S. Pat. No. 4,617,210.

FIELD OF THE INVENTION

The present invention is directed to a method and apparatus for packaging tiles. More specifically, the invention relates to a method and apparatus for packaging carpet tiles of the self-sticking type, which have a pressure release adhesive applied to one surface.

BACKGROUND OF THE INVENTION

There are two types of carpet tiles currently available. A first type requires that a self-release adhesive be applied to the floor on which the carpet tile is to be placed. There are several disadvantages in using this type of carpet tiles, including the need to apply expensive adhesive over the entire floor and difficulty in installing tiles on such a surface. A second disadvantage is that when the tiles are removed the glue which remains on the floor is both difficult and costly to remove in order to return the floor to its original surface.

Accordingly, the second type of carpet tile, which is commonly known as a self-sticking tile, uses a pressure self-release adhesive cured onto the back of the carpet tile. Such carpet tiles having the self-release adhesive are advantageous over the first type of carpet tiles in that less adhesive is required, installation is facillitated and when the carpet tiles are removed there is no messy and costly clean up necessary in order to return the floor to its original surface.

Ayotte, U.S. Pat. No. 4,380,563 proposes to package felt substrates having an adhesive applied to one surface of the substrate. Each felt substrate, with an applied adhesive, is separated from another such felt substrate, with an applied adhesive, by a release paper. The release paper is necessary to prevent the adhesive surface of one felt substrate from contacting the finished or exposed felt surface of another felt substrate. The proposed Ayotte packaging is disadvantageous, in that it is costly to provide the release paper during the manufacturing process and the release paper also presents problems of paper disposal during the time of installation of the carpet tiles.

SUMMARY OF THE INVENTION

This invention provides a carpet tile packaging apparatus and method for self-sticking carpet tiles which is an improvement over the prior art packaging methods and systems in that it obviates the above-described disadvantages of the prior art. The pressure self-release adhesive, in the present invention, is applied to the bottom surface of the carpet tiles in one of two predetermined geometrical patterns. The two predetermined geometrical patterns are complementary so that when two tiles with pressure self-release adhesives are placed back to back, the adhesive from one tile will not contact the adhesive from the other tile.

As is well known to those skilled in the art, pressure self-release adhesive can be applied to carpet tiles in several ways. In one way, an aqueous or solvent adhesive is used and upon application to the carpet tile the adhesive is cured to the back of the tile by driving out the water or solvent by a conventionally known process. A second way of applying pressure self-release adhesive to carpet tiles results in a hot melt process, in which the adhesive is applied hot so that it forms a permanent bond with the carpet tile substrate and upon cooling becomes a release adhesive to anything that it contacts.

Furthermore, the invention can also use a double faced tape in place of the pressure self-release adhesive.

One example of the present invention would be the application of pressure self-release adhesives at the outer most corners of one group of carpet tiles. A second group of carpet tiles would have adhesive placed at locations away from the four outer most corners of the carpet tiles, for example, on the outer edges of the tile intermediately located between adjacent corners. Thus, when the carpet tiles are placed back to back the adhesive from one tile would not contact the adhesive from the other tile. Furthermore, because the adhesive has been applied in such a manner that it is cured when applied to its receptor carpet tile, the adhesive is firmly bonded to the carpet tile with a significantly higher bonding strength than the bond which the exposed surface of the adhesive will form with another surface such as the back of another carpet tile or a floor.

Another example of the present invention would be the application of a special adhesive pattern to all carpet tiles such that when one carpet tile is rotated relative to a second carpet tile, the adhesive portions of the two respective tiles will not contact each other when the tiles are placed back-to-back.

When double faced tape is used in place of a pressure self-release adhesive, one side of the double faced tape has superior bonding characteristics as compared to the other side of the double faced tape which is to contact the floor.

Thus, by placing the carpet tiles of the present invention back to back so that their respective adhesive portions do not make contact, the carpet tiles can be packaged without the use of release paper.

In another embodiment, those areas of carpet tile back which do not receive adhesive are treated with non-stick material. More particularly, a non-adhesive wetting material is used which, for example, can be silicone crossed linked materials, fluorocarbons, waxes, metallic stearates or resins. The non-adhesive wetting material can be sprayed or printed on to the carpet tiles and will need to be dried or cured. The latter is needed with materials which must cross link to be effective. This alternative increases flexibility in pressure self-release adhesive selection so that highly aggressive types can be used which might otherwise have too much adhesion to an untreated tile backing surface.

Adhesive can be applied to the tiles by a plurality of hot melt adhesive guns, which can be controlled in a predetermined manner to apply the adhesive in any desired pattern. The guns would preferably be of the slot die type and would be capable of applying a thin film of adhesive onto the tile surface. Alternatively a screen type printer could be used to apply the adhesive.

Accordingly, the present invention provides the following advantages over the prior art carpet tiles. First, the use of a self-stick tile without the need for release paper saves considerable cost during manufacturing and also obviates any problems of paper disposal for the carpet tile installer. Secondly, because it is not necessary to apply a coat of adhesive to the floor, substantial savings in time of application, time of curing, the labor of application and more difficult tile installation and the cost of the adhesive, result. And finally, when the carpet tiles of the present invention are removed from the floor, since the glue is on the tiles and not on the floor, messy and costly clean ups in order to return the floor to its original surface are avoided.

BRIEF DESCRIPTION OF THE DRAWINGS

FIG. 4 is a cross section of the carpet tile of FIG. 1 along line 4—4;

FIG. 5 is a cross section of the carpet tile of FIG. 2 along line 5—5;

FIG. 6 shows one example of a packaging container for the carpet tiles as assembled in FIG. 3;

DETAILED DESCRIPTION OF THE PRESENT INVENTION

Figure 1:
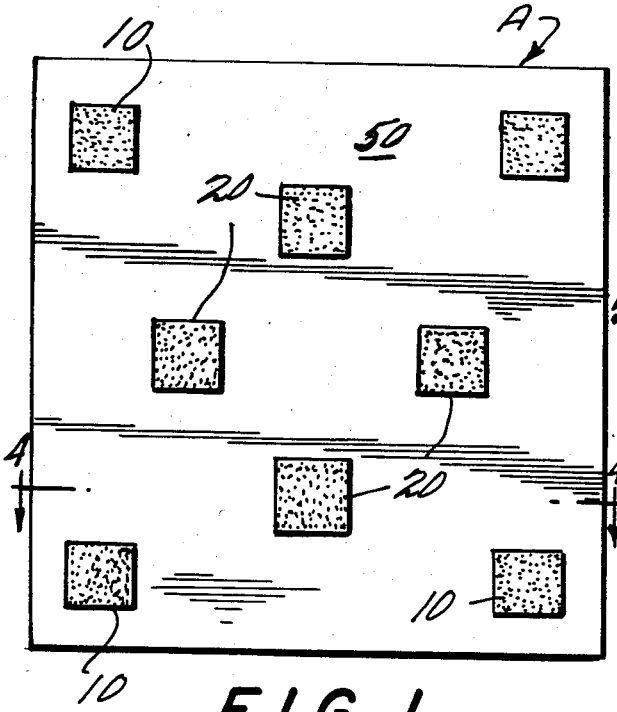
FIG. 1 shows a carpet tile having a first predetermined pattern of adhesive portions mounted on its bottom surfaces.

In FIG. 1 there is shown a first carpet tile A having a bottom surface 50 on which adhesive portions 10 and 20 are formed in a predetermined geometrical pattern. Although the adhesive portions are shown as square in shape in FIG. 1, it will be readily understood to those skilled in the art that any shape of adhesive portions would be suitable, for example, circular, elliptical, striped, etc. FIG. 4 is a cross section of carpet tile A taken along line 4—4. As can be seen in FIG. 4, the adhesive portions 10 and 20 are located on the bottom surface 50 of the carpet tile A opposite to its top surface 70.

Figure 2:
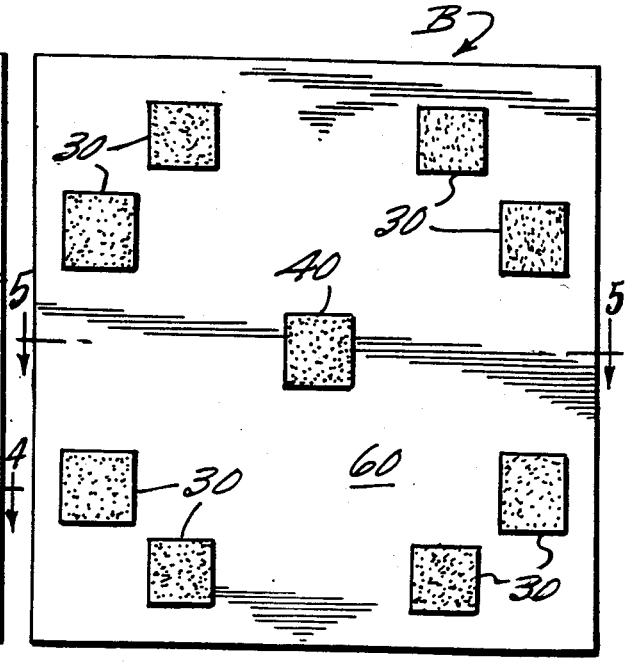
FIG. 2 shows a carpet tile having a second predetermined pattern, which differs from the first predetermined pattern of the carpet tile of FIG. 1.

FIG. 2 shows a carpet tile B having a bottom surface 60 on which are arranged adhesive portions 30 and 40 in a second predetermined geometrical pattern which is complementary to the first pattern of the carpet tile A, as will be described below. A cross section of carpet tile B along line 5—5 is shown in FIG. 5. In FIG. 5, the carpet tile B is shown to have a bottom surface 60 on which adhesive portions 30 and 40 are located opposite to the top surface 80.

Figure 3:
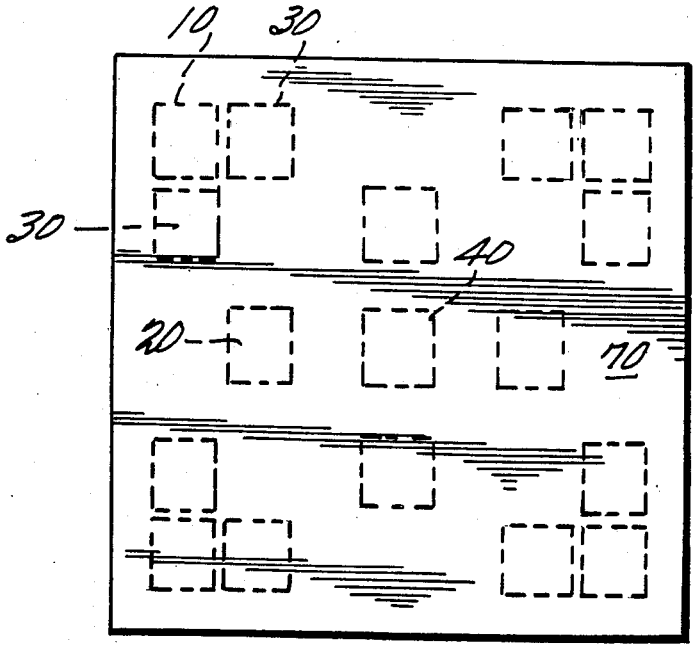
FIG. 3 shows the adhesive patterns when the first carpet tile backing is laid against the second carpet tile backing.

The geometrical arrangement of the first carpet tile A and second carpet tile B are said to be complementary to each other in that the carpet tiles A and B can be placed over top one another with none of the adhesive portions 10, 20, 30 and 40 contacting each other, as shown by the dotted lines in FIG. 3.

FIG. 3 shows the carpet tile A placed against the bottom of the carpet tile B such that the upper surface 70 of the carpet tile A is in view. Thus, the geometrical patterns of the carpet tiles A and B are said to be complementary in that they do not intersect or overlap but result in adhesive portions contacting the respective bottom surface of the adjacent carpet tile. For example, the adhesive portions 10 and 20 of carpet tile A contact the bottom surface 60 of carpet tile B and the adhesive portions 30 and 40 of carpet tile B contact the bottom surface 50 of carpet tile A. Therefore, none of the adhesive portions contact each other.

Since the adhesive portions 10, 20, 30 and 40 have been cured to their respective carpet tiles, they are firmly bonded to the bottom surface of their respective carpet tile. However, the exposed surfaces of the adhesive portions are characteristic of a pressure self-release adhesive surface so that the carpet tiles can be easily pulled apart from one another, placed into position on a floor surface and pulled up and rearranged as necessary to finalize their position on the floor surface. Furthermore, if and when the carpet tiles are to be removed from the floor surface, they are easily pulled up out of place with the adhesive portions remaining firmly bonded to the carpet tiles.

As noted above, the described construction of carpet tiles therefore allows an inexpensive and efficient packaging method whereby carpet tiles A and B are placed back to back and then stored in a carton or container 100 as shown in FIG. 6. Virtually any type of container can be used for holding the carpet tiles, including straps for strapping a plurality of paired tiles together. Upon removal from the container at the installation site, the carpet tiles are easily pulled apart for placement on the floor surface.

Figure 7A:
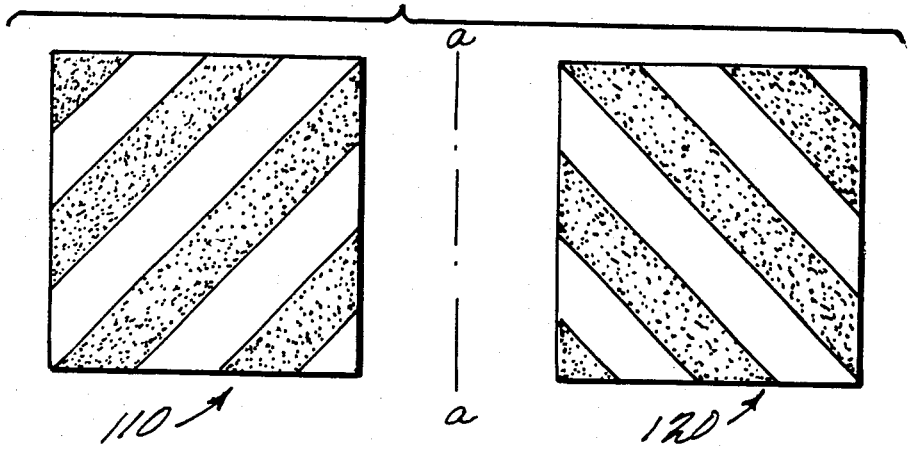
FIGS. 7A and 7B show carpet tiles having identical adhesive patterns which do not contact each other when one of the tiles is rotated relative to the other.
Figure 7B:
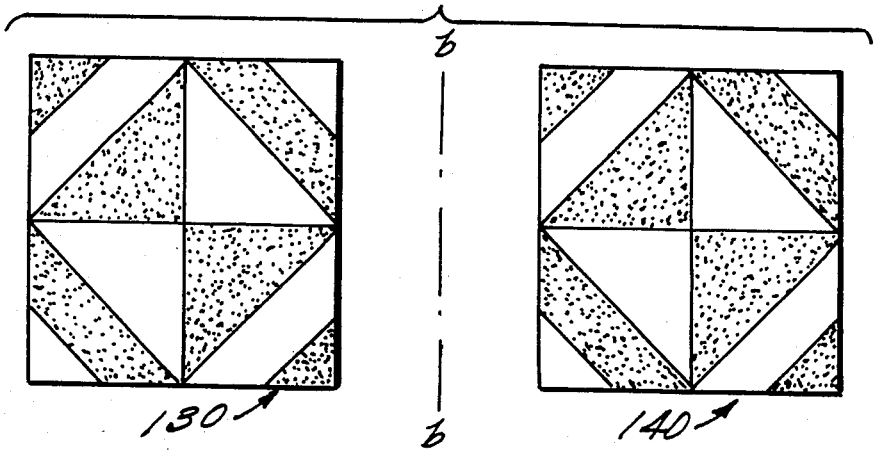

In FIGS. 7A and 7B there are shown, examples of carpet tiles having respective identical predetermined patterns which nonetheless allow carpet tiles having the same pattern to be placed back-to-back without the adhesive portions of the tiles contacting each other. For example, carpet tiles 110 and 120, shown in FIG. 7A, have an identical adhesive pattern on their back sides, but by rotating tile 120 counterclockwise through 90° to the position shown, the tiles 110 and 120 can be folded over onto each other along line a—a so that the adhesive portions on the tiles (darkened areas in FIG. 7A) do not contact each other. Similarly, carpet tiles 130 and 140 shown in FIG. 7B have identical adhesive patterns and can be folded over onto each other along line b-b, so that the adhesive portions on the tiles do not contact each other.

Figure 8A:
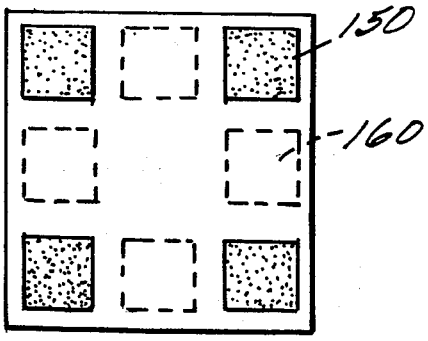
FIGS. 8A and 8B show carpet tiles in which the portions not receiving adhesive are treated with non-stick material.
Figure 8B:
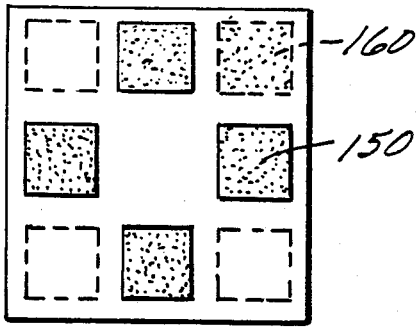

In another embodiment of the present invention, the portions of the carpet tiles which do not receive adhesive are treated with a non-adhesive wetting material (non-stick material). As shown in FIGS. 8A and 8B, adhesive is applied to portions 150 and non-stick material is applied to portions 160 of the carpet tiles. The non-stick material is positioned on the carpet tile of FIG. 8A so that it will be directly opposite to the adhesive portions on the carpet tile of FIG. 8B, when the tiles are placed back-to-back. Similarly, the non-stick material is positioned on the carpet tile of FIG. 8B so that it will be directly opposite to the adhesive portions on the carpet tile of FIG. 8A, when the tiles are placed back-to-back. Provision of the non-stick material eases separation of the packed tiles even when the paired tiles have been subjected to abnormal temperatures and pressures.

The present invention can be practiced with carpet tiles of virtually any construction. For example, carpet tiles having polyvinyl chloride, ethylene vinyl acetate, polyurethane, ethylene propylene diene mononer compound, asphalt, vinyl acetate ethylene, SBR latex, atactic polypropylene and other crystalline or amorphous synthetic resin backings are suitable for the disclosed packaging method and system. Furthermore, carpet tiles with secondary backings such as woven or non-woven polypropylene and polyester are also suitably used with this invention.

The invention may also be applicable to other types of tiles made of cork, ceramic, linoleum, or other materials.

Figure 9A:
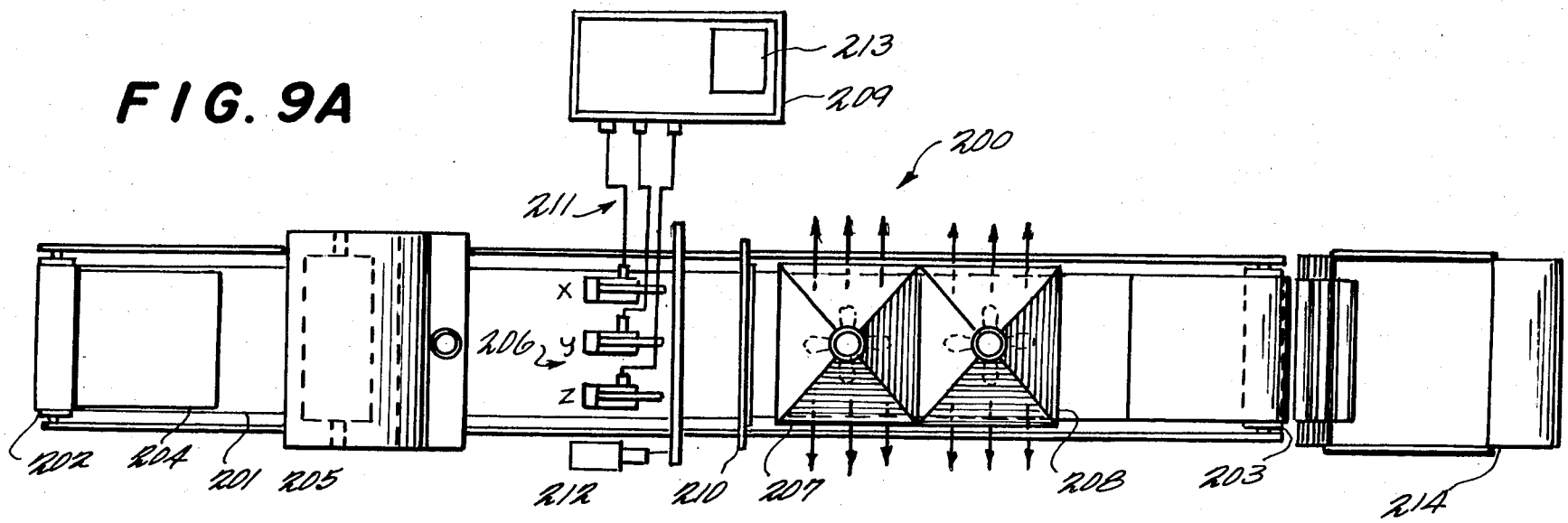
FIGS. 9A and 9B are plan and profile views, respectively of an apparatus for applying adhesive, in a predetermined pattern, to the back of a carpet tile.
Figure 9B:
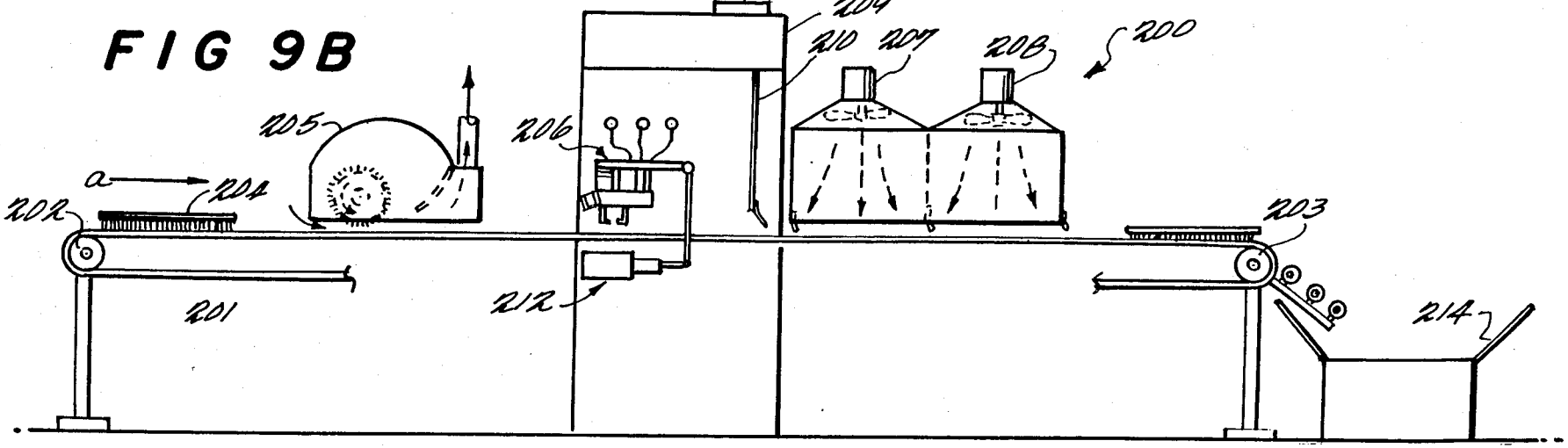

FIGS. 9A and 9B show an apparatus 200 for applying adhesive to the back surface of a carpet tile. As can be seen in the FIGURES, a conveyor belt 201 moves between rollers 202 and 203 by a driving motor (not shown). A carpet tile 204 with its back surface facing upwards is placed at one end of the conveyor belt 201. An optional cleaner or scrubber 205 is also positioned at one end of the conveyor belt for cleaning the back surface of the carpet tile prior to the application of adhesive thereto. After passing beneath the scrubber 205 the carpet tile 204 then encounters a plurality of hot melt adhesive guns 206, such as for example those available from MELTEX model number Coating Heat EP 45. Shown in FIG. 9A for illustrative purposes only are 3 such guns x, y and z.

A three pump hot melt applicator 209, for example MELTEX model number GR-41, is connected to guns x, y and z by respective heated hoses 211. The raising and lowering of guns x, y and z is controlled by electronic pattern controller 212, which for example can be provided by MELTEX mode number ES 46. The amount of adhesive supply is controlled by sequencer 213 which can be provided by Sequential Information Systems, Inc. model number SLP-80-360-16-01A, which also an be used to preprogram a particular pattern of adhesive application. The aforementioned control components can be operated so as to first apply adhesive to the back of a first carpet tile in a predetermined pattern and then apply adhesive to an immediately subsequent carpet tile in a second predetermined pattern which is complementary to the first predetermined pattern so that the two adjacent carpet tiles could be placed back to back without any adhesive from one carpet tile contacting adhesive on the second carpet tile.

The hot melt applicator 209 includes controlled heaters for maintaining the proper melt temperature of the adhesive. The adhesive is typically applied at 300° F. with the dye lip of the guns also being maintained at 300° F. in order to ensure that the bond between the adhesive and tile is maintained. However, as has been noted above, the tack between the applied adhesive and the second tile is small so that the tiles readily separate with a moderate pull.

Sequencer 213 includes a memory for storing a plurality of adhesive patterns for any number of tiles which can be varying dimensions, for example 18" tiles and 24" tiles. As noted above, the patterns are programmed into the sequencer and a change from one tile size to another is easily accomplished by manipulation of a switch (not shown). The sequencer typically includes an encoder capable of transmitting a thousand sections of data, which is divided into typically 30" of conveyor belt length. The patterns are developed by programming the start and finish of desired actions into the sequencer. Regardless of belt speed, the encoder controlls the actual length of any cycle so that apron speed can be adjusted to suit any circumstance.

In order to avoid having the lip of the hot dye in contact with tile backings except when applying adhesive, the sequencer includes extra operating channels so that the guns are raised and lowered independently of gun flow control. Accordingly, in the preferred embodiment, the first part of a cycle is to lower the gun lip on to the tile just prior to starting adhesive flow. The gun is held in this position until it is released by the sequencer. During this period the adhesive control valve is opened on the gun to permit flow through whatever length the pattern has been determined for. The flow control is turned off followed by a short interval to wipe the dye slot clean before raising the gun again. Thus, the sequencer sequence becomes (1) lower gun, (2) start adhesive flow, (3) stop adhesive flow and (4) raise gun.

As noted above, although the FIGURES show a total of three guns, additional guns could be added for more complex or involved adhesive patterns. In the embodiment shown in FIGS. 9A and 9B, the center gun y can be in a fixed pattern at the center line of the table and the two outside guns x and z can be moved left and right in order to accomodated 18" and 24" tile patterns.

Cooling fans 207 and 208 are installed following the adhesive application section in order to remove heat from the applied adhesive. It has been observed that the tack between tiles is less when cool tiles are joined. An optional excess adhesive removal means 210 can be provided between the gun assembly 206 and cooling fans 207 and 208.

In system 200, tiles can be hand fed onto the machine transport apron at rates 15 to 20 tiles per minute. The speed limit relates to the ability of the "packer" to place the tiles into cartons (such as carton 214). However, the invention can also include an automatic feeding and automatic packing means in order to increase the through put rate of system 200.

In order to avoid minor problems from adhesive deterioration, a small flow of carbon dioxide is provided to the top of the hot melt applicator to displace air and associated oxidation of the product.

Figure 10A:
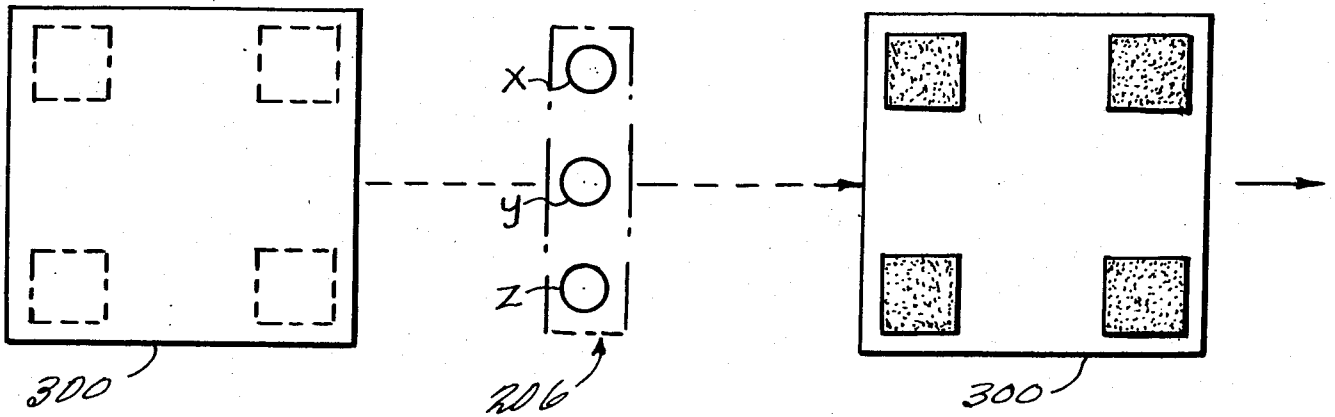
FIGS. 10A and 10B show carpet tiles having one example of complementary adhesive patterns applied by the apparatus shown in FIGS. 9A and 9B.
Figure 10B:
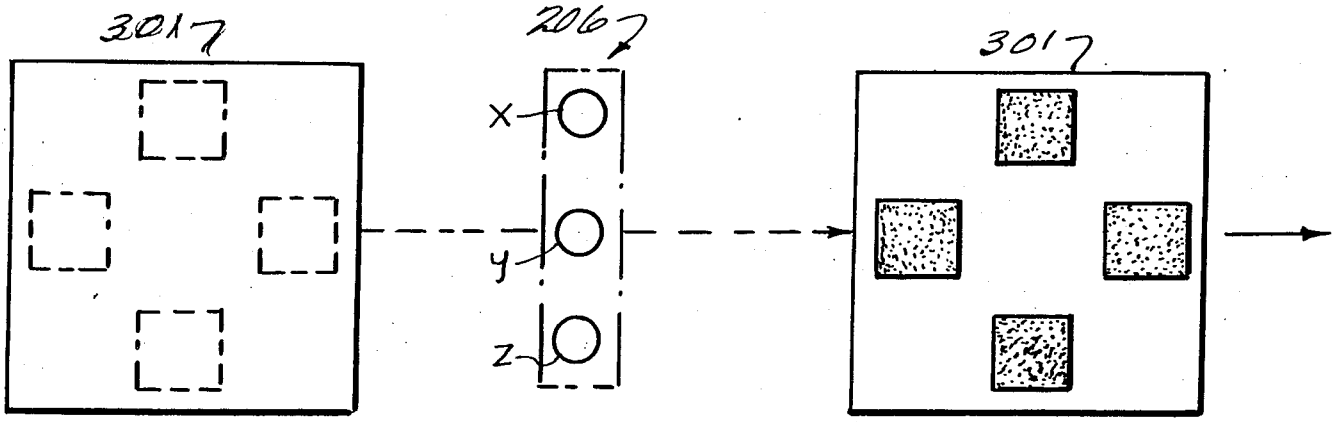

FIG. 10A shows an 18" carpet tile which after passing beneath gun assembly 206 receives adhesive at its four external corners. A complimentary pattern is shown in FIG. 10B where carpet tile 301 after passing beneath hot gun assembly 206 receives adhesive pattern at its intermediate external edges. As would be readily understood from the above, the carpet tile shown in FIG. 10A can be placed in back to back contact with the carpet tile of FIG. 10B without the adhesive from one tile contacting the adhesive from the other tile. In FIGS. 10A and 10B it will be readily apparent that the center gun y does not apply adhesive to the tile shown in FIG. 10A while all three guns x, y and z apply adhesive to the carpet tile shown in FIG. 10B.

Figure 11A:
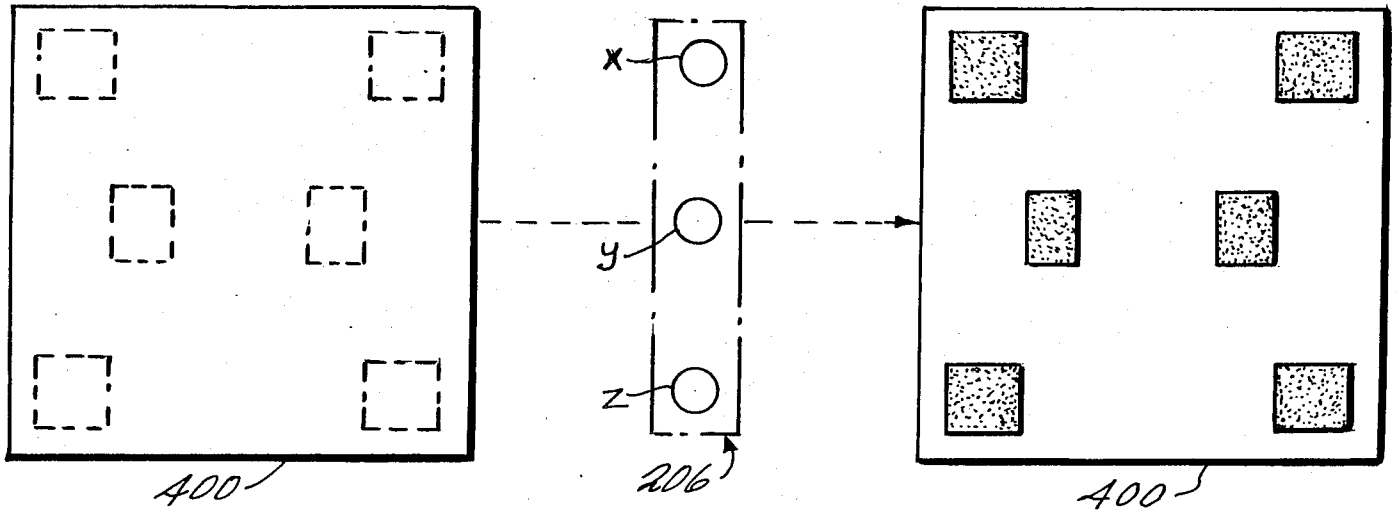
FIGS. 11A and 11B show carpet tiles having a second example of complementary adhesive patterns applied by the apparatus shown in FIGS. 9A and 9B.
Figure 11B:
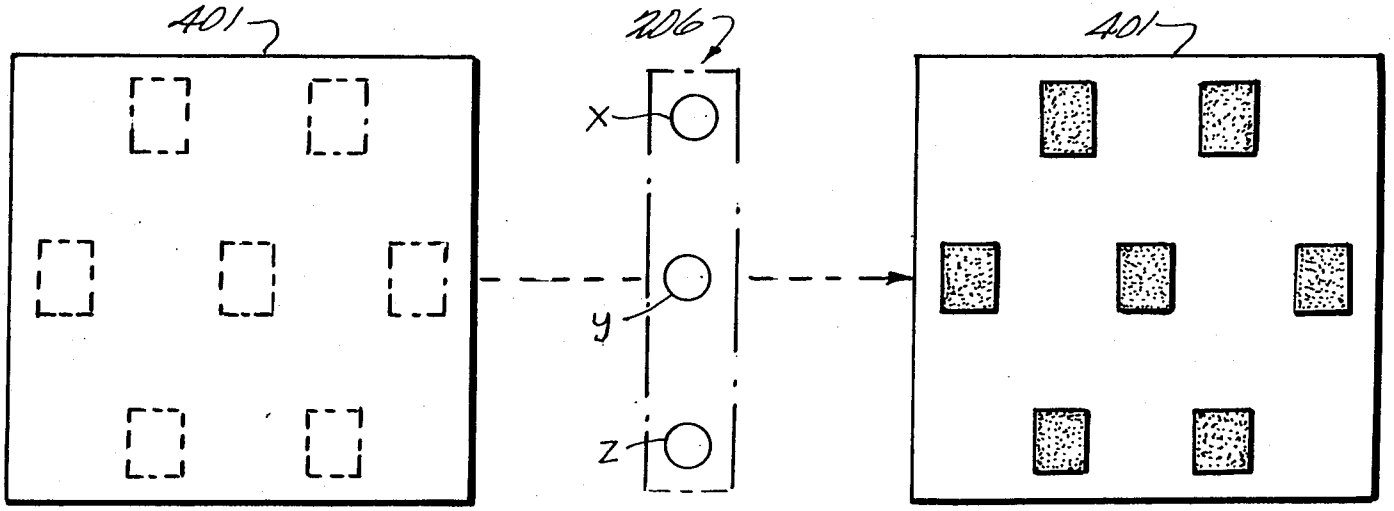

Similarly, FIGS. 11A and 11B show 24" carpet tiles which receive, respectively, a first and second predetermined pattern of adhesive. More particularly, FIG. 11A shows that each of guns x, y and z applies two blocks of adhesive to carpet tile 400. FIG. 11B, however, shows that guns x and z apply two blocks of adhesive while center gun y applies three blocks of adhesive to carpet tile 401. Further, the tiles shown in FIGS. 11A and 11B can be placed back to back without the adhesive from one tile contacting the adhesive from the other tile. Typically, the adhesive blocks shown in FIGS. 10A, 10B, 11A and 11B are 4" squares.

Although it has been indicated above that the sequencer 213 can be programmed to alternate patterns of applied adhesive to adjacent tiles it should also be understood that the sequencer could be programmed to first apply adhesive in a single particular pattern to a number of sequential tiles and then apply the complementary pattern to a second sequential number of tiles.

Figure 12:
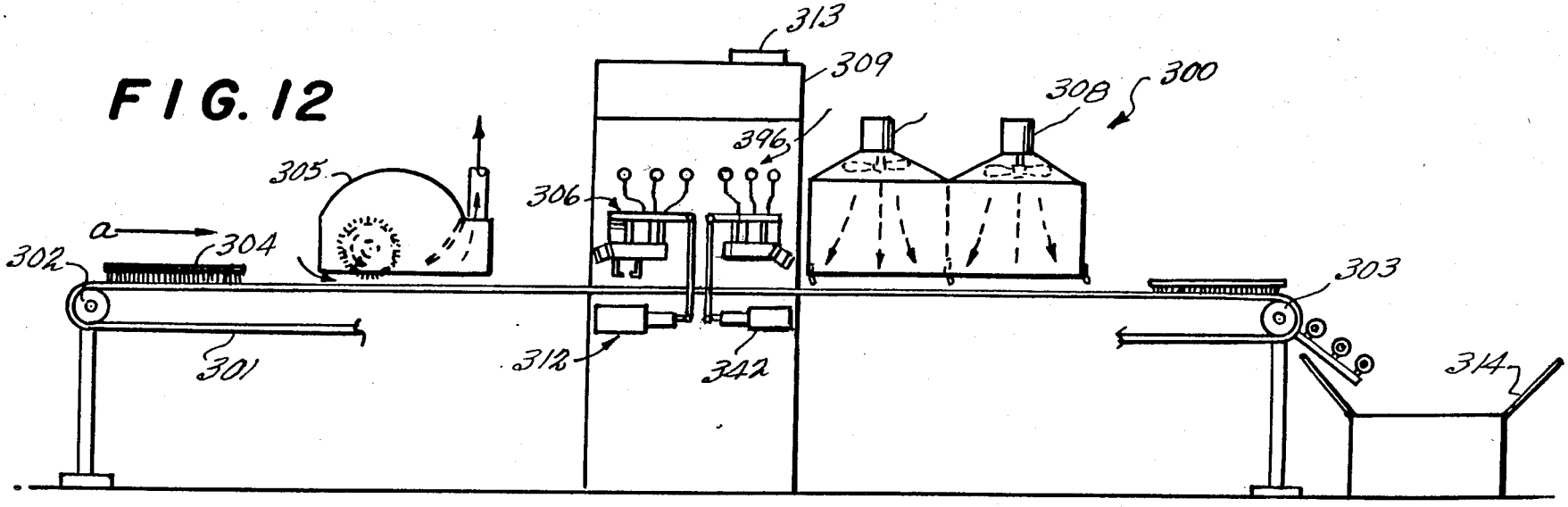
FIG. 12 is a profile view of an apparatus for applying both adhesive and non-stick material in a predetermined pattern on the back of a carpet tile, similar to the view of FIG. 9B.

FIG. 12 is similar to FIG. 9B in showing the profile of an apparatus, and reference numerals in FIG. 12 for elements identical with elements in FIG. 9B have been incremented by 100. FIG. 12 also includes guns 346 for applying non-stick material, such as the material discussed in connection with carpet tiles having non-stick material applied to them hereinabove. This material is supplied to the guns 346 from a suitable supply, not shown, under control of sequencer 313. Guns 346 are raised and lowered as necessary by controller 342, in a manner analogous to the operation of controller 212, discussed in connection with FIG. 9B. As will be apparent, sequencer 313, operating analogously to sequencer 213 described in connection with FIGS. 9A and 9B, is programmed so that the adhesive applied by adhesive applying guns 306 is in a pattern complementary to the pattern applied by guns 346.

It should be appreciated that the above described description of the preferred embodiments do not limit the scope of the present invention in any way, and that various changes and modifications may be made without departing from the spirit and scope of the present invention.

What is claimed is:

1. A tile system comprising a plurality of tiles having adhesive and non-stick material on the backs thereof, said adhesive being provided for adhering said tiles to a surface, being non-releaseably applied to said backs and having release properties as to surface other than those covered with adhesive, said adhesive and said non-stick material being arranged on said backs such that two of said plurality of tiles may be placed in back-to-back contact so that the adhesive on one tile will contact the non-stick material on the other tile and vice versa, whereby said two tiles in back-to-back contact may be readily separated from one another.

2. A tile system as claimed in claim 1, wherein said tiles are carpet tiles.

3. A tile system as claimed in claim 2, wherein said carpet tiles have secondary backings such as any one of woven polypropylene, non-woven polypropylene and polyester.

4. A tile system as claimed in claim 2, wherein said carpet tiles have resin backings such as any one of polyvinyl chloride, ethylene vinyl acetate, polyurethane, ethylene propylene diene monomer compound, ashpalt, vinyl acetate ethylene, SBR latex, atactic polypropylene, and other crystalline or amorphous synthetic resins.

5. A tile system as claimed in claim 1, wherein said tiles are any one of cork, ceramic and linoleum.

6. A tile system as claimed in claim 1, wherein said non-stick material is a non-adhesive wetting material and can comprise any one of silicone cross linked materials, fluorocarbons, waxes, metallic stearates and resins.

7. A packaging system comprising:

a plurality of pairs of tiles each pair having a first tile having a first pattern of adhesive and non-stick material and a second tile having a second pattern of adhesive and non-stick material, said first and second patterns being selected to allow adhesive areas of said first tile to contact non-stick material areas of said second tile and to allow non-stick material areas of said first tile to contact adhesive areas of said second tile, when adhesive and non-stick material sides of said first and second tiles face each other; and container means for holding said plurality of pairs of tiles.

8. A packaging system as claimed in claim 7, wherein said adhesive comprises hot melt adhesive.

9. A packaging system as claimed in claim 7, wherein said first and second patterns of adhesive and non-stick material comprise a plurality of square shaped portions of adhesive and non-stick material cured onto said first and second tiles.

10. A packaging system as claimed in claim 7, wherein said tiles are carpet tiles.

11. A tile system as claimed in claim 10, wherein said carpet tiles have secondary backings such as any one of woven polypropylene, non-woven polypropylene and polyester.

12. A tile system as claimed in claim 10, wherein said carpet tiles have resin backings such as any one of polyvinyl chloride, ethylene vinyl acetate, polyurethane, ethylene propylene diene monomer compound, asphalt, vinyl acetate ethylene, SBR latex, atactic polypropylene, and other crystalline or amorphous synthetic resins.

13. A tile system as claimed in claim 7, wherein said tiles are any one of cork, ceramic and linoleum.

14. A packaging system as claimed in claim 7, wherein said non-stick material is a non-adhesive wetting material and can comprise any one of silicone cross linked materials, fluorocarbons, waxes, metallic stearates and resins.

15. A packaging system comprising:

a first group of tiles having adhesive portions and non-stick material portions applied to a surface in a first predetermined pattern;

a second group of tiles having adhesive portions and non-stick material portions applied to a surface in a second predetermined pattern, so that when adhesive and non-stick material sides of tiles from said first group face adhesive and non-stick material sides of tiles from said second group, thereby forming pairs of tiles, said adhesive portions are prevented from contacting each other; and container means for holding said paris of tiles.

16. A packaging system as claimed in claim 15, wherein said adhesive portions comprise hot melt adhesive.

17. A packaging system as claimed in claim 15, wherein said first and second predetermined patterns of adhesive portions comprise a plurality of square shaped adhesive and non-stick material portions cured onto said first and second groups of tiles.

18. A packaging system as claimed in claim 15, wherein said tiles are carpet tiles.

19. A tile system as claimed in claim 18, wherein said carpet tiles have secondary backings such as any one of woven polypropylene, non-woven polypropylene and polyester.

20. A tile system as claimed in claim 18, wherein said carpet tiles have resin backings such as any one of polyvinyl chloride, ethylene vinyl acetate, polyurethane, ethylene propylene diene monomer compound, asphalt, vinyl acetate ethylene, SBR latex, atactic polypropylene, and other crystalline or amorphous synthetic resins.

21. A tile system as claimed in claim 15, wherein said tiles are any one of cork, ceramic and linoleum.

22. A packaging system as claimed in claim 15, wherein said non-stick material is a non-adhesive wetting material and can comprise any one of silicone cross linked materials, fluorocarbons, waxes, metallic stearates and resins.

23. A method of packaging a plurality of tiles comprising:

applying pressure sensitive adhesive and non-stick material to the bottom surface of a first group of said plurality of tiles in a first predetermined pattern;

applying pressure sensitive adhesive and non-stick material to the bottom surface of a second group of said plurality of tiles in a first predetermined pattern;

forming a plurality of paired tiles wherein each pair comprises one tile from said first group and one tile from said second group arranged so that their bottom surfaces contact, wherein said pressure sensitive adhesives of said first and second predetermined patterns do not contact each other and said non-stick materials of said first and second predetermined patterns do not contact each other; and placing said paired tiles into a container.

24. A method as claimed in claim 23, wherein an aqueous adhesive is applied in said adhesive applying steps.

25. A method as claimed in claim 23, wherein a solvent based adhesive is applied in said adhesive applying steps.

26. A method as claimed in claim 23, wherein a hot melt adhesive is applied in said adhesive applying steps.

27. A method as claimed in claim 23, wherein said adhesive comprises a double-faced tape.

28. A method as claimed in claim 23, wherein a non-adhesive wetting material comprising any one of silicone cross linked materials, fluorocarbons, waxes, metallic stearates and resins is applied in said non-stick material applying steps.

29. A tile system comprising a plurality of tiles having adhesive on the backs thereof arranged in a single specific pattern, said adhesive being provided for adhering said tiles to a surface, being non-releaseably applied to said backs and having release properties as to surfaces other than those covered with adhesive, said adhesive being arranged on said backs such that two of said plurality of tiles may be placed in back-to-back contact so that the adhesive on one tile will not contact the adhesive on the other tile and vice versa, whereby said two tiles in back-to-back contact may be readily separated from one another.

30. A tile system as claimed in claim 29 wherein non-stick material is applied to those portions of the tiles which do not receive adhesive.

31. An apparatus for applying adhesive to the backs of carpet tiles, said apparatus comprising:

a plurality of adhesive guns for applying adhesive to the backs of the carpet tiles;

means for supplying adhesive to said plurality of adhesive guns; and control means connected to said supplying means and to said plurality of adhesive guns for applying adhesive to the backs of carpet tiles in any of a plurality of predetermined patterns.

32. An apparatus as in claim 31, further comprising a movable conveyor belt for conveying carpet tiles beneath said plurality of adhesive guns.

33. An apparatus as in claim 32 further comprising cooling means for cooling the carpet tiles after said plurality of adhesive guns has applied adhesive.

34. An apparatus as in claim 32 further comprising cleaning means for cleaning the carpet tiles before said movable conveyor belt conveys the carpet tiles to said plurality of adhesive guns.

35. An apparatus as in claim 31, said control means being provided for lowering said plurality of adhesive guns when adhesive is being applied to the carpet tiles and for raising said plurality of adhesive guns at all other times.

36. An apparatus as in claim 31, said supplying means maintaining said adhesive at 300° Farenheit.

37. An apparatus for applying adhesive and non-stick material to the backs of carpet tiles, said apparatus comprising:

a first plurality of adhesive guns for applying adhesive to the backs of carpet tiles;

a second plurality of guns for applying non-stick material to the backs of carpet tiles;

means for supplying adhesive to said first plurality of adhesive guns and for supplying non-stick material to said second plurality of guns; and control means connected to said supplying means and to said first and second pluralities for applying adhesive and non-stick material to the backs of carpet tiles in any one of a plurality of predetermined patterns.

38. An apparatus as in claim 37, further comprising a movable conveyor belt for conveying carpet tiles beneath said pluralities of guns.

39. An apparatus as in claim 38 further comprising cooling means for cooling the carpet tiles after said pluralities of guns have applied adhesive and non-stick material.

40. An apparatus as in claim 38 further comprising cleaning means for cleaning the carpet tiles to said pluralities of guns.

41. An apparatus as in claim 37, said control means being provided for lowering said first plurality of adhesive guns when adhesive is being applied to the carpet tiles and for raising said plurality of adhesive guns at all other times.

42. An apparatus as in claim 37, said supplying means maintaining said adhesive at 300° Farenheit.

* * * * *

UNITED STATES PATENT AND TRADEMARK OFFICE

CERTIFICATE OF CORRECTION

PATENT NO. : 4,680,209

DATED : July 14, 1987

INVENTOR(S) : ZYBKO et al

It is certified that error appears in the above-identified patent and that said Letters Patent is hereby corrected as shown below:

Column 7, line 59, change "ashpalt" to --asphalt--.
Title page:
Item 73, change "MD" to --NC--.

Figure 12, change reference numeral "396" to --346-- which should be identified by one hash mark rather than two.

Figure 12, reference numeral "307" needs to be labeled.

Signed and Sealed this

Fourth Day of May, 1993

*Attest:*

Michael K. Kirk

MICHAEL K. KIRK

*Attesting Officer*

*Acting Commissioner of Patents and Trademarks*